United States Patent [19]

St. Martin

[11] Patent Number: 4,581,075

[45] Date of Patent: Apr. 8, 1986

[54] SELF-PROPELLED WATER BORNE POOL CLEANER

[75] Inventor: Marty St. Martin, Phoenix, Ariz.

[73] Assignee: Maxi-Sweep, Inc., Phoenix, Ariz.

[21] Appl. No.: 712,147

[22] Filed: Mar. 15, 1985

[51] Int. Cl.[4] ..... E04H 3/20

[52] U.S. Cl. ..... 134/18; 15/1.7; 134/21; 210/169

[58] Field of Search ..... 15/1.7; 134/21; 210/169

[56] References Cited

U.S. PATENT DOCUMENTS

| | | | |
|---|---|---|---|
| 2,646,889 | 7/1953 | Dulak | 15/1.7 |
| 3,412,862 | 11/1968 | Chaplin | 15/1.7 |
| 3,416,176 | 12/1968 | Ravitts | 15/1.7 |
| 4,240,174 | 12/1980 | Thiem et al. | 15/1.7 |

*Primary Examiner*—Edward L. Roberts

*Attorney, Agent, or Firm*—Cahill, Sutton & Thomas

[57] ABSTRACT

A self-powered water pump and filter unit is removeably mounted upon a water borne vessel to draw an attached vacuum head across the bottom of a pool while simultaneously providing a propulsion force to propel the vessel along the water surface. Directional control of the propelled vessel is provided by manually controlling the direction of the propulsion force.

29 Claims, 4 Drawing Figures

SELF-PROPELLED WATER BORNE POOL CLEANER

The present invention relates to pool cleaners and, more particularly to water borne pool cleaners.

Conventional sized swimming pools of the type installed at most residences have incorporated therein an automatic water circulation and filtration system. Various devices have also been employed to perform a scrubbing action with water jets to direct debris toward the drain. Public pools, and pools found in commercial establishments, such as resorts, hotels, motels, etc., are generally somewhat larger than residential pools and because of the degree of use of such pools, seldom have self-contained cleaning systems. Such pools must be cleaned manually and most are cleaned by commercial pool service companies. These pool service companies employ portable pool cleaning units having a pump, a filter system, a length of intake hose for drawing water from the pool and a further length of hose for discharging the pumped water back into the pool. A vacuum head mounted at the end of a wand is attached to the intake hose. An operator, by appropriate manipulation of the wand, passes the vacuum head across the bottom and sides of the pool to draw in debris entrained water. The debris entrained water is filtered and discharged back into the pool. Enumerable configurations of such pool cleaning units are available in the marketplace.

The water pump of the pool cleaning units discussed above may be powered by an electric motor having an appropriate electrical cord to be plugged into a source of electrical power. Alternatively, a self-contained internal combustion engine may be employed as part of the pool cleaning unit to obviate dependency upon a source of electrical power and to eliminate the hazard of electrical shock should the pool cleaning unit become inadvertently submerged or bathed by water splash.

The size of the pool which can be manually cleaned by the above described type of pool cleaning units is primarily a function of the length of the wand and intake hose and the physical strength of the operator necessary to manipulate the wand.

For very large swimming pools it becomes essentially impossible to clean the center bottom surface of the pool because of physical constraints imposed by the length of wand needed and the strength of the operator. Heretofore, normal migration and dispersion of debris has been relied upon to prevent excessive debris build up on the surfaces which cannot be reached by an operator.

The present invention is directed to apparatus for rendering accessible all surfaces of a swimming pool to be cleaned without imposing excessive or extraordinary demands upon the equipment or an operator. To obtain access to all of the swimming pool surfaces, a self-powered pool cleaning unit is removeably mounted upon a suitably sized vessel which will float on the surface of the pool. The vacuum head is secured to the stern of the vessel by a cord or the like to draw the vacuum head across the surface to be cleaned as the vessel moves across the surface of the water. The intake hose extends from the drawn vacuum head to the pool cleaning unit to provide suction at the operative intake ports of the vacuum head. The water discharged from the pool cleaning unit is conveyed by the discharge hose to an outlet jet. The filtered water discharged through the jet provides a source of propulsion or thrust for the vessel to propel it. By swivel mounting the jet and providing control means therefor useable by an operator, the thrust angle, with respect to the longitudinal axis of the vessel, can be changed and will provide directional control of the vessel as the vessel traverses a pool. Accordingly, by directing the vessel along the surface of the swimming pool, the vacuum head will be drawn along any path determined by the operator and the whole bottom surface of a pool can be vacuumed. To clean the walls and junction between the walls and bottom, the pool cleaning unit may be removed from the vessel and placed upon the perimeter surface of the pool and the vacuum head is attached to a wand for cleaning the walls and wall junction in the conventional manner.

It is therefore a primary object of the present invention to provide a self-propelled water borne pool cleaner.

Another object of the present invention is to provide a vessel for receiving any conventional pool cleaning unit to clean a pool.

Still another object of the present invention is to provide apparatus for cleaning all walls and all of the bottom of any sized pool.

Yet another object of the present invention is to provide a vessel for receiving pool cleaning unit which unit will vacuum the pool bottom surface and simultaneously will propel the vessel.

A further object of the present invention is to provide a vessel having means cooperating with a pool cleaning unit to propel and control the direction of travel of the vessel.

A still further object of the present invention is to provide a pool cleaning system having the capability of vacuuming both the walls and bottom of any sized pool.

A yet further object of the present invention is to provide a method for cleaning pools.

These and other objects of the present invention will become apparent to those skilled in the art as the description thereof proceeds.

The present invention will be described with greater specificity and clarity with reference to the following drawings, in which.

Figure 1:
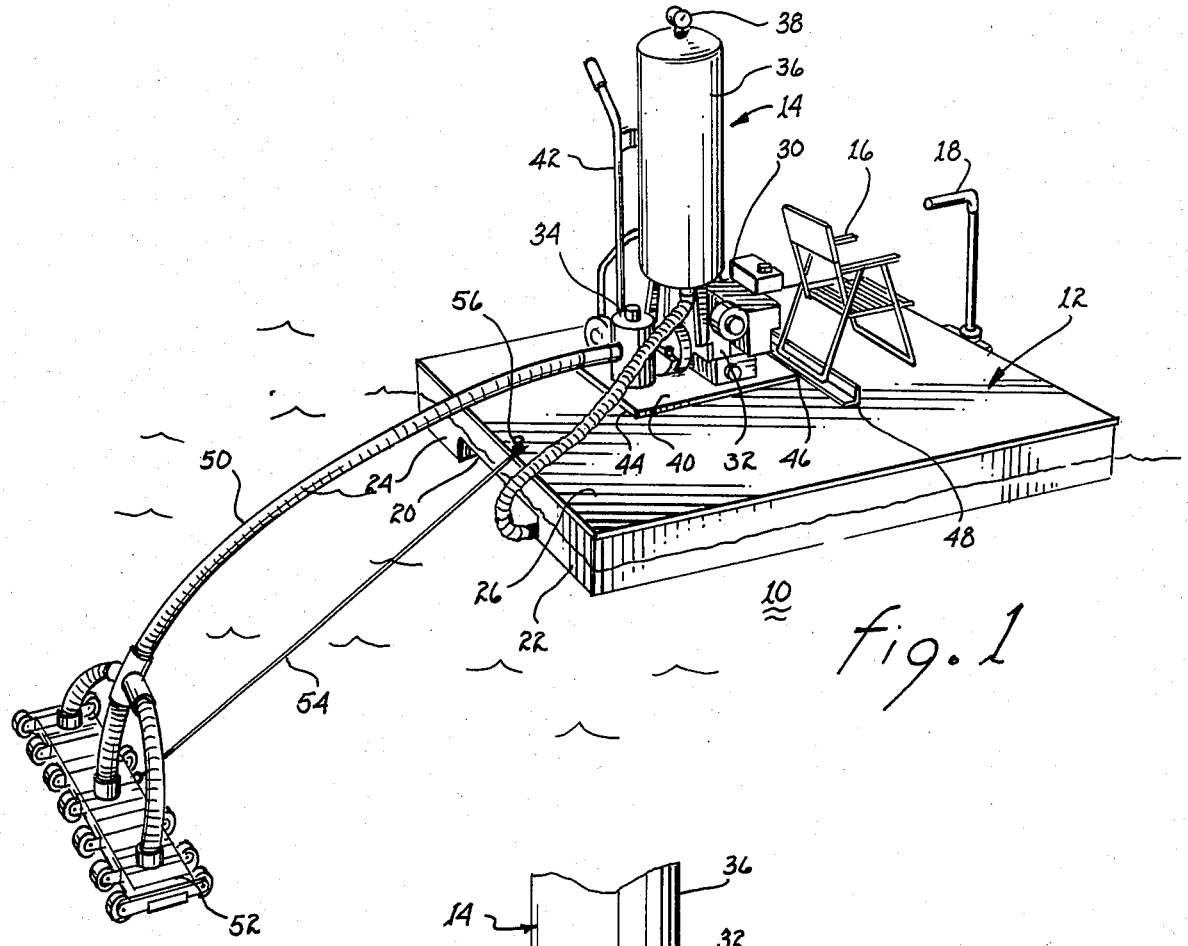
FIG. 1 illustrates a perspective view of a self-propelled water borne pool cleaner.

Referring to FIG. 1, there is shown a self-propelled water borne pool cleaning apparatus 10 for vacuuming and cleaning the bottom of any sized pool or body of water. The apparatus includes a vessel 12, which may be configured in the nature of a raft, as illustrated. A self-contained pool cleaning unit 14 is removeably mounted upon the vessel. A chair 16, or the like, may be incorporated for the comfort of an operator. A tiller 18 provides the operator with a means for steering vessel 12 across the water surface.

Vessel 12 is sized to provide adequate flotation for the equipment placed thereon and the weight of the operator; accordingly, its size and shape may vary, depending upon circumstances. To provide the greatest degree of stability, a channel 20 extending longitudinally amidship may be incorporated to ensure adequate flotation at the edges of the vessel to minimize heeling of the vessel when pool cleaning unit 14 is loaded or unloaded and when the operator may move about the vessel. Channel 20 also has the further benefit of providing a degree of longitudinal directional stability when the vessel is under way. As shown, pontoon like elements 22, 24 may be attached to deck 26 to define the channel.

Pool cleaning unit 14 is preferably self-powered to avoid dependency upon an on land source of electrical power. Accordingly, it may include an internal combustion engine 30 for operating a water pump 32. A leaf trap 34 is incorporated as an initial filter upstream from the pump to remove large sized inflowing debris. A further filter 36 downstream of the pump removes any remaining water entrained debris. Suitable gauges 38 and other monitoring devices and controls may be incorporated. Preferably, the engine, pump and two filters are secured to a rigid platform 40 attached to or formed as part of hand-dolly 42. By mounting the pool cleaning unit upon such a hand-dolly, it can readily be maneuvered on and off vessel 12. Moreover, most portable commercially available pool cleaning units incorporate such a dolly and vessel 12 is intended to be useable therewith. Various attachment and positioning means 44, 46 are employed to quickly releasably secure pool cleaning unit 14 in place upon vessel 12. For the comfort of the operator, chair 15 may be permanently or removeably attached to vessel 12 by attachment means 48 or the like.

Intake hose 50 extends rearwardly from leaf trap 34 to convey water from the inlet of the intake hose to the leaf trap. A vacuum head 52 is attached to the inlet of the intake hose to regulate the source of the water inflow. The vacuum head is configured to travel upon the bottom of the pool and create a low pressure environment over the surface traversed to draw in water and the debris entrained therein. Some scrubbing action upon the bottom surface to entrain the debris will also occur due to the turbulent water flow adjacent the vacuum head. The scrubbing may be enhanced by employing brushes or similar scrubbing means as part of the vacuum head to dislodge the debris. A cord 54 extends from a post 56 attached to the stern of the vessel to vacuum head 52 to pull the vacuum head behind the vessel. Accordingly, movement of the vessel across the water surface will draw the vacuum head across the bottom of the pool along an equivalent path.

Discharge hose 60 is attached to conduit 62 extending from the outlet of filter 36. Terminal end 64 of the discharge hose is attached to inlet 66 of U-shaped conduit 68 secured to the lower end of tiller 18. An outlet jet 70 extends rearwardly from outlet 72 of the U-shaped conduit. Journaling means 74 interconnects tiller 18 at the bow of vessel 12 to permit pivotal movement of the tiller and commensurate pivotal movement of the U-shaped conduit. Thereby, the angle of water discharge through outlet jet 70 may be varied with respect to the longitudinal axis of vessel 12. For the sake of convenience, discharge hose 60 may be run through channel 20 from the stern to the U-shaped conduit; other means for interconnecting conduit 62 with the outlet jet are also contemplated. In example, the tiller may be stern mounted to minimize the length of the discharge hose and the number of bends through which the discharge water must flow.

The filtered water discharged through outlet jet 70 will produce thrust or a propulsion force. The propulsion force will propel vessel 12 across the pool surface in an opposite direction along the axis of the propulsion force. By pivoting tiller 18, the axis of the propulsion force can be angularly varied with respect to the longitudinal axis of vessel 12. Any angular deviation of the propulsion force from the longitudinal axis of the vessel will result in a laterally oriented force acting upon the bow of the vessel to turn the vessel. The lateral force is a function of or proportional to the deviation angle whereby the sharpness of any turn can be regulated commensurate with the speed of the vessel.

Accordingly, pool cleaning unit 14 provides both a propulsion force for vessel 12 to propel it across the water surface and a means for steering the vessel under control of an operator while it is vacuuming the bottom.

Figure 3:
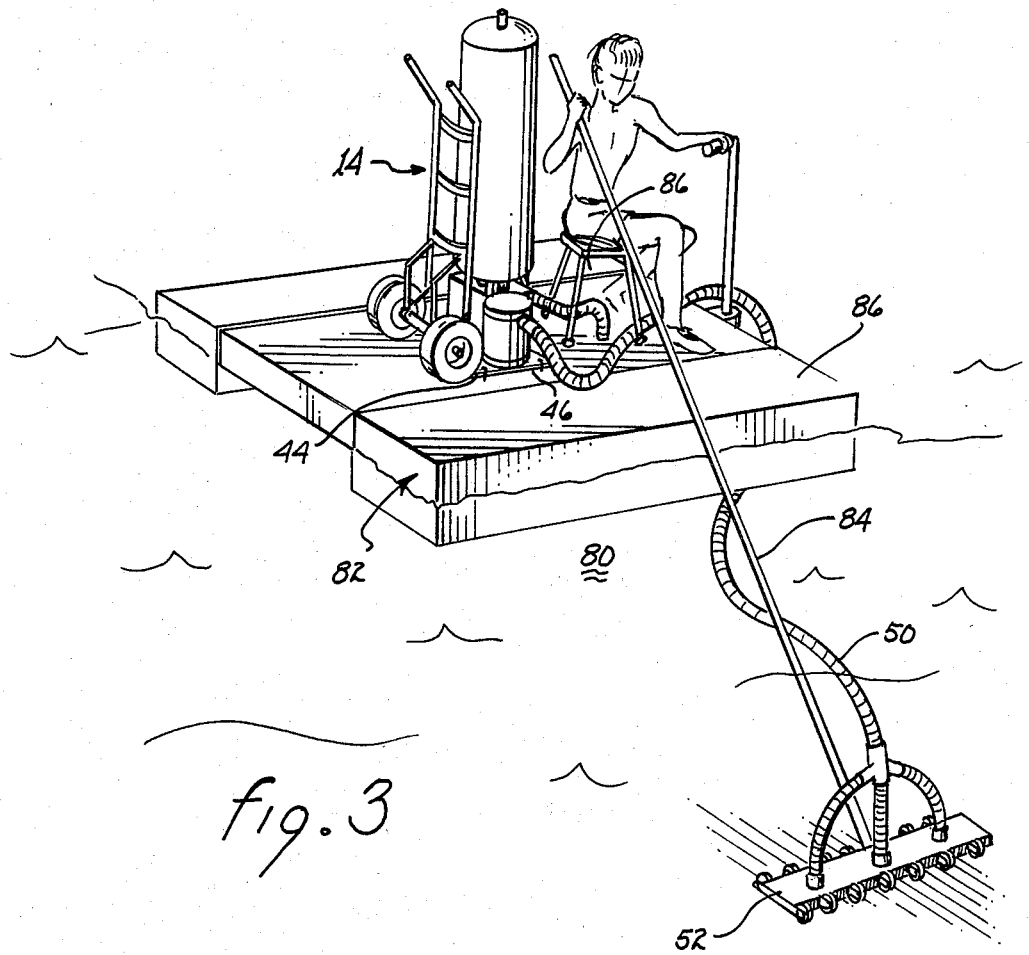
FIG. 3 illustrates a variant of the self-propelled water borne pool cleaner.
Figure 4:
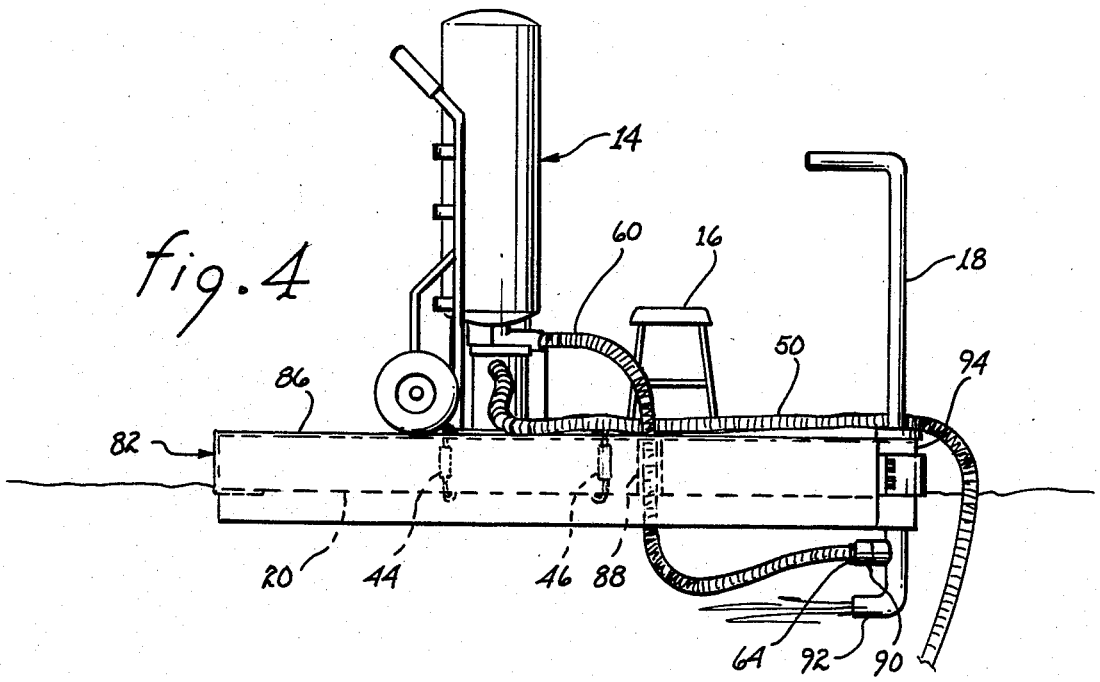
FIG. 4 is a partial cross-sectional view of the variant shown in FIG. 3.

Referring jointly to FIGS. 3 and 4, a variant 80 of the water borne pool cleaning apparatus is illustrated. A pool cleaning unit 14 is removeably mounted upon vessel 82 by attachment and positioning means 44, 46. Vacuum head 52 is operatively attached to the pool cleaning unit through intake hose 50. Operator control of the path traversed by the vacuum head is achieved by means of a wand 84 extending from the vacuum head. With such wand, the operator, seated upon chair 86, or standing upon deck 86 of vessel 82, can manipulate the vacuum head across any part of the bottom surface of the pool which is within reach by the wand. Moreover, the operator can also manipulate the vacuum head along the junction between the bottom and sides of the pool or along the sides of the pool. Since the vessel can be simultaneously propelled in any direction, the whole pool can be vacuumed.

Figure 2:
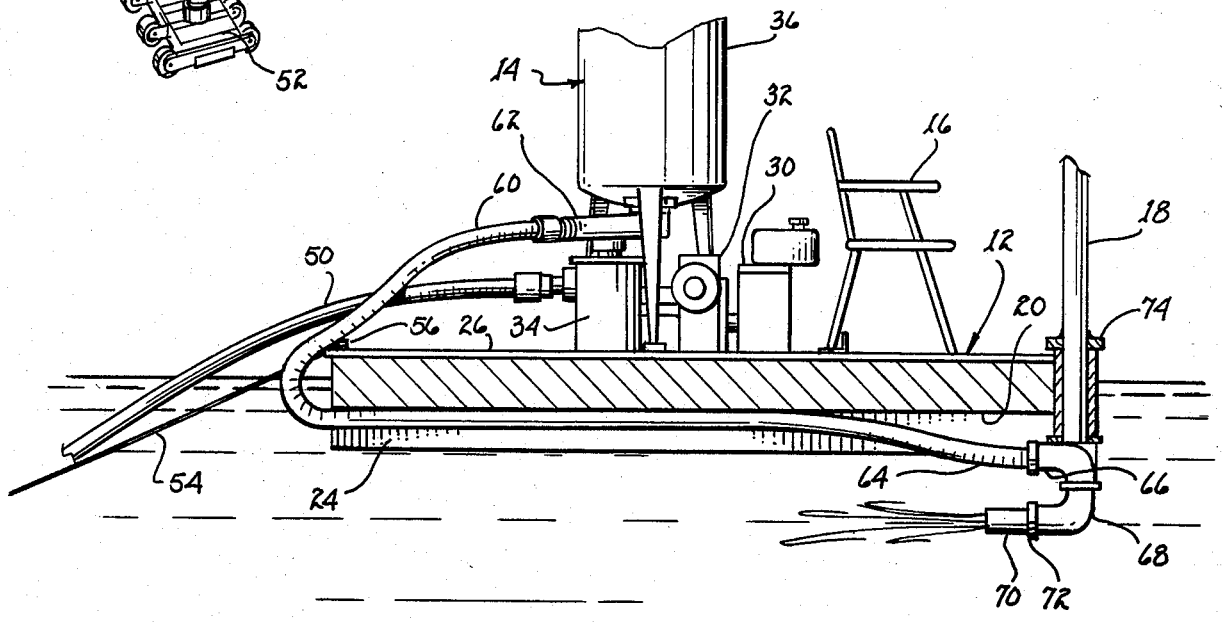
FIG. 2 is a partial cross-sectional view of certain of the operative elements of the water borne pool cleaner.

As particularly illustrated in FIG. 4, discharge hose 60 may be conveyed through a channel 88 extending from deck 86 to the bottom of vessel 82. Terminal end 64 of the discharge hose is connected to inlet 90 of water jet 92. The water jet is operatively associated with tiller 18 through journal means 94 or the like. It is to be understood that discharge hose 60 may be interconnected with the outlet jet in the manner illustrated in FIG. 2. Moreover, the location of intake hose 50 with respect to vessel 82 may be varied to accommodate the necessary manipulation of the vacuum head.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A water borne pool cleaning apparatus, said apparatus comprising in combination:

(a) a vessel;

(b) a pool cleaning unit having an intake hose, a vacuum head operatively associated with the intake hose for drawing in debris entrained water adjacent the surface to be cleaned, a water pump for maintaining a water flow through said pool cleaning unit, a filter system for filtering the debris entrained water, and a discharge hose for discharging filtered water;

(c) means for detachably attaching said pool cleaning unit upon said vessel;

(d) means for propelling said vessel in response to the discharge of the discharged water; and (e) means for steering said vessel to render accessible to the vacuum head the surfaces of the pool to be cleaned.

2. The apparatus as set forth in claim 1 wherein said propelling means comprises an outlet jet in fluid communication with said discharge hose.

3. The apparatus as set forth in claim 2 wherein said steering means includes journaling means for pivotally mounting said outlet jet.

4. The apparatus as set forth in claim 3 wherein said steering means further includes a tiller for controlling the pivot angle of said outlet jet.

5. The apparatus as set forth in claim 4 including means for accommodating an operator upon said vessel to manipulate said tiller.

6. The apparatus as set forth in claim 1 including means for moving the vacuum head across the surface to be cleaned.

7. The apparatus as set forth in claim 6 wherein said moving means comprises a cord extending from said vessel to the vacuum head.

8. The apparatus as set forth in claim 1 wherein said vessel includes flotation elements at the sides of said vessel to minimize heeling of said vessel during attachment and detachment of said pool cleaning unit.

9. The apparatus as set forth in claim 1 wherein said vessel includes means for accommodating passage of the discharge hose from said pool cleaning unit to said propelling means.

10. Pool cleaning apparatus for floating a pool cleaning unit upon the surface of a pool having at least a bottom to be cleaned and wherein the pool cleaning unit includes a vacuum head for drawing in debris entrained water adjacent the surface to be cleaned, an intake hose extending from the vacuum head for conveying the debris entrained water, a pump for drawing the water through the intake hose, a filter system for filtering the debris entrained water and a discharge hose for discharging the filtered water, said apparatus comprising in combination:

(a) a vessel;
(b) means for detachably attaching the pool cleaning unit upon said vessel;
(c) means operatively associated with the discharge hose for utilizing the discharged water to provide a propulsion force to propel the vessel; and
(d) means for steering the vessel.

11. The apparatus as set forth in claim 10 wherein said utilizing means comprises an outlet jet.

12. The apparatus as set forth in claim 11 wherein said steering means includes means for pivoting said outlet jet to vary the angular direction of the propulsion force.

13. The apparatus as set forth in claim 12 wherein said steering means further includes a tiller to control the pivotal position of said outlet jet.

14. The apparatus as set forth in claim 13 including means for accommodating an operator upon said vessel to manipulate said tiller.

15. The apparatus as set forth in claim 10 including means for moving the vacuum head across the surface to be cleaned.

16. The apparatus as set forth in claim 15 wherein said moving means comprises a cord for trailing the vacuum head behind said vessel.

17. The apparatus as set forth in claim 15 wherein said moving means comprises a wand manipulatable by an operator positioned upon said vessel.

18. The apparatus as set forth in claim 10 wherein said vessel includes flotation elements at the sides to counteract heeling of the vessel.

19. The apparatus as set forth in claim 18 wherein said vessel further includes a channel intermediate said flotation elements for providing directional stability to said vessel.

20. A method for cleaning the surfaces of a pool, said method comprising the steps of:

(a) floating a vessel on the surface of the pool;
(b) detachably attaching a pool cleaning unit upon the vessel, the pool cleaning unit having an intake hose for inflowing debris entrained water, a water pump, a filter for filtering the water and a discharge hose for discharging the filtered water;
(c) moving a vacuum head in fluid communication with the intake hose across a surface of the pool to be cleaned and to draw in the debris entrained water proximate the vacuum head;
(d) propelling the vessel with a propulsion force provided by the discharge hose; and
(e) steering the vessel to control the surface area of the pool accessible to the vacuuming effect of the vacuum head.

21. The method as set forth in claim 20 wherein said step of steering includes the step of angularly redirecting the propulsion force.

22. The method as set forth in claim 20 wherein said step of moving includes the step of trailing the vacuum head behind the vessel.

23. The method as set forth in claim 20 wherein said step of moving includes the step of manually directing the vacuum head.

24. The method as set forth in claim 20 wherein said propelling step includes the step of directing the propulsion force generally rearwardly of the vessel.

25. The method as set forth in claim 24 wherein said step of steering includes the step of angularly redirecting the propulsion force.

26. The method as set forth in claim 20 wherein the pool cleaning unit is wheel mounted and wherein the step of attaching includes the step of rolling the pool cleaning unit on to and off from the vessel.

27. The method as set forth in claim 20 wherein said step of propelling and steering comprise the step of ejecting the discharged water through a pivotally mounted outlet jet.

28. The method as set forth in claim 27 including the step of pivoting the outlet jet to control the direction of travel of the vessel.

29. The method as set forth in claim 28 wherein said pivoting step is performed manually by an operator located upon the vessel.

* * * * *